United States Patent [19]

Langlois et al.

[11] Patent Number: 4,978,254

[45] Date of Patent: Dec. 18, 1990

[54] TOOL FOR MACHINING AND BEVELLING POLYCARBONATE OPHTHALMIC GLASSES LENSES USING A STANDARD GRINDING MACHINE

[75] Inventors: Jean-Pierre M. F. Langlois, Rouen; Michel J. M. Lecerf, La Saussaye, both of France

[73] Assignee: Briot International, Elbeuf, France

[21] Appl. No.: 387,597

[22] Filed: Jul. 31, 1989

[30] Foreign Application Priority Data

Aug. 31, 1988 [FR] France ..... 88 11404

[51] Int. Cl.[5] ..... B26D 1/12

[52] U.S. Cl. ..... 407/33; 407/42; 407/61; 51/206 P

[58] Field of Search ..... 51/206 R, 206 P, 284 E; 407/33, 42, 61, 51; 125/15

[56] References Cited

U.S. PATENT DOCUMENTS

| | | | |
|---|---|---|---|
| 2,268,599 | 1/1942 | Kinney et al. | 51/206 R |
| 2,477,153 | 7/1949 | Succop | 407/51 |
| 3,831,236 | 8/1974 | Coburn et al. | 407/61 |
| 4,164,329 | 8/1979 | Higby | 407/42 |
| 4,171,926 | 10/1979 | Dusza | 407/61 |
| 4,685,440 | 8/1987 | Owens | 51/206 R |

FOREIGN PATENT DOCUMENTS

| | | | |
|---|---|---|---|
| 0460669 | 12/1950 | Italy | 407/61 |

*Primary Examiner*—Robert A. Rose

*Attorney, Agent, or Firm*—Martin Smolowitz

[57] ABSTRACT

A machining and bevelling tool, which is adaptable to a standard grinding machine for ophthalmic glasses, includes a metal body (1) having in its periphery a V shaped groove (2) and at least two teeth (3) each in the form of a small inserted plate (4) presenting a notch of corresponding V shape which protrudes in said groove (2), a shallow adjacent recess (8) being provided in front of each tooth (3), considering the direction of rotation of the tool. The diameter of the tool is larger than that of an ophthalmic glass, and substantially equal to that of a standard grinding wheel for ophthalmic glasses.

10 Claims, 1 Drawing Sheet

TOOL FOR MACHINING AND BEVELLING POLYCARBONATE OPHTHALMIC GLASSES LENSES USING A STANDARD GRINDING MACHINE

BACKGROUND OF THE INVENTION

The present invention concerns generally the machining and bevelling of glasses for spectacles, and more particularly relates to a tool for the working glasses, lenses made of transparent polycarbonate plastic material.

Due to its inherent properties of transparency and breaking strength, the polycarbonate is now widely used in the production of safety spectacles, and also for ophthalmic lenses glasses. However, the machining of polycarbonate is extremely difficult since its melting temperature is relatively low, and it is therefore impossible to use standard grinding and bevelling machines for machining polycarbonate glasses, due to an excessively rapid clogging of the tools which are usually used on the standard type machine tools.

It has therefore been necessary heretofore to effect the grinding and bevelling operations with special machines for working polycarbonate lens blanks, the machines being fitted with small grinding tools having a diameter smaller than the diameter of the glass to be machined, and which grinding tools are rotated at high speed. Although such tools are usually made of tungsten carbide, their working life is undersirably very short.

SUMMARY OF THE INVENTION

The object of the invention is to overcome these shortcomings by providing a tool specially adapted for machining polycarbonate material, and which tool can be used on a standard grinding and bevelling machine instead of the usual grinding wheel used for grinding glass and rotated at the same speed as the latter.

The invention therefore provides a tool for machining and bevellin ophthalmic polycarbonate glasses lenses, which tool can be mounted on a standard grinding machine instead of the usual grinding wheel, characterized in that it comprises a metal body portion having at its rim a groove of V shaped cross section, and including at least two teeth, each tooth being in the form of a plate provided with a correspondingly V shaped notch and fixed on said rim so as to protrude in said groove, each of said teeth being positioned adjacent to and behind a recess, in relation to the direction of rotation of the tool. The diameter of the tool is larger than the diameter of an ophthalmic glass, and substantially corresponds to that of a standard grinding wheel for ophthalmic glasses.

The tool according to the invention may conveniently have up to five teeth spaced apart around its rim.

DESCRIPTION OF THE DRAWINGS

The following description, with reference to the accompanying drawings, given by way of a non-limitative example, will explain how the invention can be carried out.

In the drawings.

DESCRIPTION OF THE PREFERRED EMBODIMENTS

Refering to the drawings, the tool in accordance with the invention comprises a disc shaped rotatable metal body portion 1, e.g. made of steel, having on its rim a groove 2 of V shaped cross section, which is identical to the peripheral groove of a standard grinding wheel for ophthalmic glasses.

Figure 2:
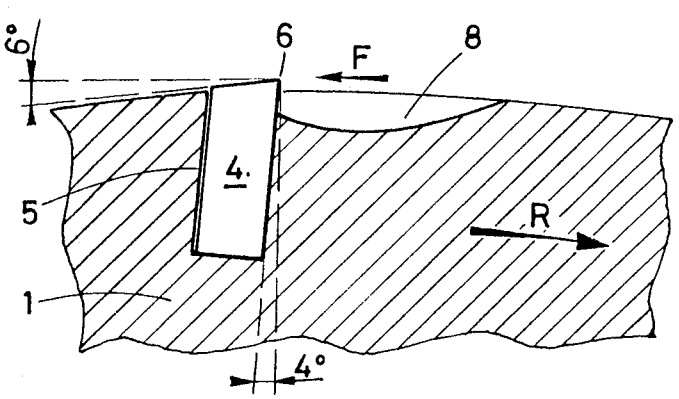
FIG. 2 is an enlarged view showing one tooth of the tool.
Figure 3:
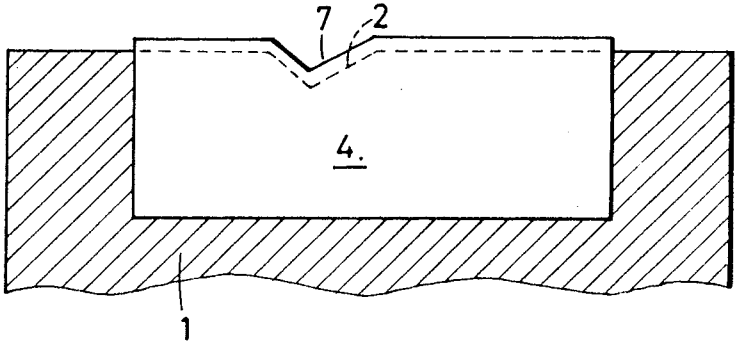
FIG. 3 is a transverse view of the tooth, shown in the direction of arrow F in FIG. 2.

Several teeth 3, which are more clearly shown in FIG. 2 and FIG. 3, are spaced apart in body 1 and protrude above said groove 2. Each of said teeth is an insert in the form of a small plate 4 made of polycrystalline diamond or tungsten carbide, fixedly received in a transverse notch 5 in which it is brazed.

The uppper or leading edge 6 of each plate 4 protrudes above the rim surface about 0.3 mm in the groove 2, and has a V shaped notch 7 identical to the cross-sectional shape of said groove 2. In other words, the V shaped outline of the notch 7 in the plate 4 is slightly raised in relation to the V shaped outline of groove 2 of the tool, after sharpening the plate.

A sloping surface forming a fillet angle of about 6° is provided behind said upper edge 6 of the plate 4, and the front face of said plate is positioned at an angle of about 4° in relation to the corresponding radius of the body portion of the tool body 1.

Each tooth 3 is preceded, considering the direction of rotation of the tool (arrow R), with a shallow recess 8, the bottom of which is curved in said rotation direction along a circle 8 being a radius of about 7 mm, said recess having about 0.9 mm in depth, 5 mm in length and having the same width as plate 4.

The included angle of the cross section of groove 2 is between 110° and 130°, its depth is in the range of 0.7 and 1.2 mm and its width is at least 18 mm.

The tool according to the invention is adapted to be mounted in lieu of the standard grinding wheel of a grinding and bevelling machine ophthalmic glass lenses, and it is used to work polycarbonate blanks at the same rotation speed as the standard grinding wheels. The tool thus allows to use a standard grinding machine by simply interchanging the present tool with the grinding wheel, instead of using a special machine with a small diameter grinding tool rotated at high speed.

The grinding machine on which the tool is used needs no substantial modifications, it being only necessary to control the lower speed of the glass on a standard grinding wheel by any known means, which does not enter in the scope of the invention.

Figure 1:
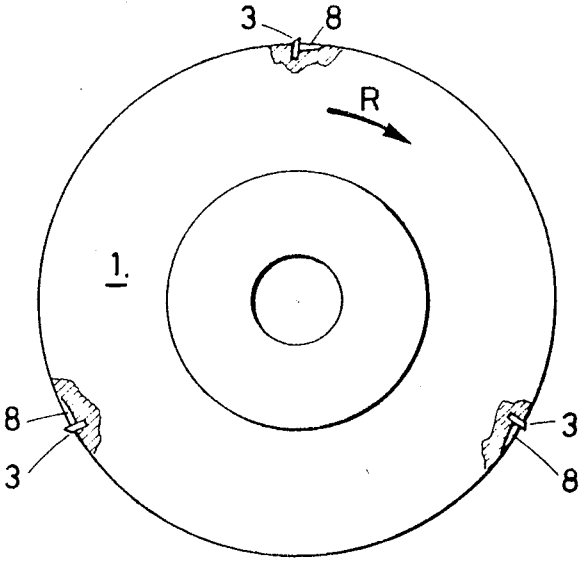
FIG. 1 is a side elevational view of a disc-shaped rotatable tool according to the invention.
Figure 4:
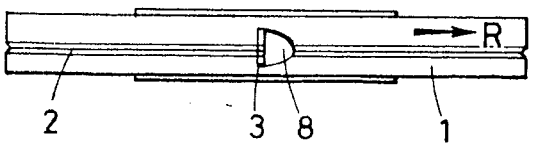
FIG. 4 is a view showing the tool of FIG. 1 perpendicularly to its axis.

In the embodiment shown in FIG. 1 drawing, the tool according to the invention has three teeth 3; this number should be not less than 2 and maybe up to 5. Although more than five teeth can be provided within the scope of the invention, it has been found that more than five teeth only increases the cost without any improvement in the efficiency of cutting or machining ophthalmic polycarbonate lenses.

What is claimed is:

1. A tool for machining and bevelling polycarbonate ophthalmic glasses lenses, which tool is adapted to be mounted on a standard machine for grinding and bevelling ophthalmic glasses, characterized in that the tool comprises a metal body portion having a rim, said rim having a groove of V-shaped cross section and at least two teeth, each tooth being in the form of an inserted small plate having a correspondingly V-shaped notch but with the plate slightly protruding in said groove, a shallow recess being provided in said body rim (just) in front of and adjacent each tooth in the direction of rotation of the tool.

2. A tool according to claim 1, wherein said tool is provided with between two and five teeth spaced apart around said rim.

3. A tool according to claims 1, wherein the outline of said notch of each said tooth is raised and protrudes radially in relation to the outline of said groove.

4. A tool according to claim 3, wherein the radial height of said tooth protrusion above said rim is about 0.3 mm after sharpening.

5. A tool according to claim 1, wherein the included angle of the V-shaped groove and the V-shaped notch of said plate is between 110° and 130°, its depth is between 0.7 mm and 1.2 mm, and its width is at least 18 mm.

6. A tool according to claim 1, wherein the curvature of said recess, in the direction of rotation of the tool is that of an arc of a circle having a radius of about 7 mm, its length in the direction of rotation is about 5 mm, its depth if about 0.9 mm, and said recess width is substantially equal to that of said tooth.

7. A tool according to claim 6, wherein the leading or front face of each said tooth is inclined rearwardly about 4° in relation to the radius of the body portion.

8. A tool according to claim 2, wherein the included angle of the V-shaped groove and V-shaped notch of said plate is between 110° and 130°, its depth is between 7 mm and 1.2 mm, and said notch width is at least 18 mm.

9. A tool according to claim 3, wherein the included angle of the V-shaped groove and V-shaped notch of said plate is between 110° and 130°, its depth is between 0.7 mm and 1.2 mm, and said notch width is at least 18 mm.

10. A tool according to claim 4, wherein the included angle of the V-shaped groove and V-shaped notch of said plate is between 110° and 130°, its depth is between 0.7 and 1.2 mm, and said notch width is at least 18 mm.

* * * * *